US005310455A

United States Patent [19]

Pasch et al.

[11] Patent Number: 5,310,455

[45] Date of Patent: May 10, 1994

[54] TECHNIQUES FOR ASSEMBLING POLISHING PADS FOR CHEMI-MECHANICAL POLISHING OF SILICON WAFERS

[75] Inventors: Nicholas F. Pasch, Pacifica; Thomas G. Mallon, Santa Clara; Mark A. Franklin, Scott's Valley, all of Calif.

[73] Assignee: LSI Logic Corporation, Milpitas, Calif.

[21] Appl. No.: 911,814

[22] Filed: Jul. 10, 1992

[51] Int. Cl.[5] ..... B24D 13/14

[52] U.S. Cl. ..... 156/636; 51/131.1; 51/131.2; 51/131.3; 51/131.4; 51/132; 51/283 R; 51/297

[58] Field of Search ..... 156/636; 51/125, 131.1, 51/131.2, 131.3, 131.4, 132, 283 R, 297

[56] References Cited

U.S. PATENT DOCUMENTS 2,768,483 10/1956 Hurst ..... 51/297

3,653,857 4/1972 Field ..... 51/297

*Primary Examiner*—Asok Pal

*Attorney, Agent, or Firm*—Gerald E. Linden; Michael D. Rostoker

[57] ABSTRACT

A technique for mounting polishing pads to a platen in chemi-mechanical semiconductor wafer polishing apparatus is disclosed. A lower pad is mounted to the platen, and is trimmed to the size of the platen. An upper pad is mounted to the lower pad, and is sized so that an extreme outer edge portion of the upper pad extends beyond the trimmed outer edge of the lower pad. The outer edge portion of the upper pad is deformed downwardly, towards the lower pad. In this manner, polishing slurry is diverted from the pad-to-pad interface. Additionally, an integral annular lip can be formed on the front face of the upper pad, creating a reservoir for slurry to be retained on the face of the upper pad for enhancing residence time of the polishing slurry prior to the slurry washing over the face of the upper pad.

9 Claims, 4 Drawing Sheets

TECHNIQUES FOR ASSEMBLING POLISHING PADS FOR CHEMI-MECHANICAL POLISHING OF SILICON WAFERS

TECHNICAL FIELD OF THE INVENTION

The present invention relates to techniques for polishing semiconductor devices, more particularly to techniques of chemical-mechanical ("chemi-mechanical" or "chem-mech") polishing of wafers.

BACKGROUND OF THE INVENTION

Chemi-mechanical polishing of semiconductor wafers is useful, at various stages of device fabrication, for planarizing irregular top surface topography, inter alia. For example, in the process of fabricating modern semiconductor integrated circuits, it is necessary to form conductive lines or other structures above previously formed structures. However, prior structure formation often leaves the top surface topography of the silicon wafer highly irregular, with bumps, areas of unequal elevation, troughs, trenches and/or other surface irregularities. As a result of these irregularities, deposition of subsequent layers of materials could easily result in incomplete coverage, breaks in the deposited material, voids, etc., if subsequent layers were deposited directly over the aforementioned highly irregular surfaces. If the irregularities are not alleviated at each major processing step, the top surface topography of the surface irregularities will tend to become even more irregular, causing further problems as layers stack up in further processing of the semiconductor structure.

Depending upon the type of materials used and their intended purposes, numerous undesirable characteristics are produced when these deposition irregularities occur. Incomplete coverage of an insulating oxide layer can lead to short circuits between metallization layers. Voids can trap air or processing gases, either contaminating further processing steps or simply lowering overall device reliability. Sharp points on conductors can result in unusual, undesirable field effects. In general, processing high density circuits over highly irregular structures can lead to very poor yield and/or device performance.

Consequently, it is desirable to effect some type of planarization, or flattening, of integrated circuit structures in order to facilitate the processing of multi-layer integrated circuits and to improve their yield, performance, and reliability. In fact, all of today's high-density integrated circuit fabrication techniques make use of some method of forming planarized structures at critical points in the fabrication process.

Planarization techniques generally fall into one of several categories: chemical/mechanical ("chemi-mechanical", or "chem-mech") polishing techniques; leveling with a filler material then etching back in a controlled environment; and various reflow techniques. Etching techniques can include wet etching, dry or plasma etching, electro-polishing, and ion milling, among others. A few less common planarization techniques exist, such as direct deposition of material into a trench by condensing material from a gaseous phase in the presence of laser light. Most of the differences between modern planarization techniques exist in the points in processing that the different techniques are applied, and in which methods and materials are used.

The present invention is directed to a chemi-mechanical polishing process, which generally involves rubbing a wafer with a polishing pad in a slurry containing both an abrasive and chemicals. Typical slurry chemistry is KOH (Potassium Hydroxide), having a pH of about 11. Generally, polishing slurry is expensive, and cannot be recovered or reused. Typical usage (feed) rates for slurry are on the order of 175 ml (milli-liters) per minute. A typical silica-based slurry is "SC-1" available from Cabot Industries. Another, more expensive slurry based on silica and cerium (oxide) is Rodel "WS-2000".

Chemi-mechanical polishing is described in U.S. Pat. Nos. 4,671,851, 4,910,155, 4,944,836, all of which patents are incorporated by reference herein. When chemi-mechanical polishing is referred to hereinafter, it should be understood to be performed with a suitable slurry, such as Cabot SC-1.

The current state of the art in dielectric film polishing for silicon wafers strongly suggests (requires) the use of more than one polishing pad. For example, two pads are assembled together into a "stack", which may be termed a "composite polishing pad". The (upper) top pad, which performs the actual polishing (i.e., contacts the wafer), is typically stiffer than the more compliant bottom pad, which is mounted to a rotating platen. A pressure sensitive adhesive (PSA) provided by the pad manufacturer on the back face of the pads is typically used to adhere the pads together and to the platen. The platen (and pads) rotates, and a semiconductor wafer mounted to a carrier is lightly urged against the exposed face of the upper polishing pad. The wafer may also be rotated, and may also be moved in an arcuate path across the face of the upper pad, resulting in a complex polishing motion. Generally, the wafer contacts the pad in an area away from its outer edge and away from its center or, in other words, generally in an area described by about the middle two-thirds the radius "r" of the pad (i.e., avoiding the innermost and outermost pad areas corresponding to $r=0$ through $r/6$, and $5r/6$ through r, respectively).

FIG. 1 shows a typical technique for chemi-mechanical polishing. A first, lower disc-shaped pad 102 (PAD A) having a layer of pressure sensitive adhesive 104 on its back face is adhered (shown exploded) to the front face of a rotating platen 106 (PLATEN). A second, upper disc-shaped pad 108 (PAD B) having a layer of pressure sensitive adhesive 110 on its back face is adhered (shown exploded) to the front face of the lower pad 102. The pads 102 and 108 form a composite pad "stack". The platen 106 is rotated, and a metered stream of slurry 112 (shown as dots) from a slurry supply 114 is delivered via a slurry feed 116 to the front face of the upper pad 108 (PAD B).

Evidently, centrifugal forces and gravity will cause the slurry to flow (wash) over the periphery of the upper pad 108 (PAD B). This is especially evident since the front face of PAD B is specifically intended to be extremely planar for planar polishing of the wafer. This planarity, however, allows the slurry to flow easily off of the face of PAD B, thereby reducing the slurry's "residence time" on the face of the upper pad. Normally, slurry washes over the face of the upper pad before it is efficiently employed (i.e., fully depleted) for polishing, and typically cannot be recovered and recycled.

A silicon wafer 120 is mounted to a carrier 122, and is lightly pressed (flat, coplanar) against the front surface of the upper pad (PAD B) so that formations (on the pad-confronting face of the wafer) sought to be polished are acted upon by the action of the upper pad (PAD B) and the slurry. Typically, the pads 102 and 108 and the platen 106 are on the order of 20–33 inches in diameter, but can be as large as 36 inches in diameter, the wafer is on the order of 4–6 inches in diameter and, as mentioned above, polishing is performed in the center ⅔ portion of the upper pad (PAD B).

A reservoir 130 contains the platen, pads, carrier, wafer and polishing slurry.

As the slurry is used, it exits the front surface of the upper pad 108 (PAD B) and, as noted above, is not recovered. Evidently, the slurry must be fed onto PAD B at the rate that it exits PAD B, and preferably the rate would be optimized so that the slurry is entirely used, with no loss of un-depleted (un-consumed) slurry. However, this is generally not the case, and the slurry feed rate is established to be higher than would be necessary to deplete the slurry. The slurry is illustrated in FIG. 1 as a single layer of dots on the face of the upper pad, indicating that it is difficult to retain slurry on the front face of the upper pad (PAD B).

Typical pad materials are: (1) for the lower pad 102 (PAD A), foamed polyurethane; and (2) for the upper pad 108 (PAD B), polyester felt stiffened with a polyurethane resin (matrix). The adhesive backings 104 and 110 for the pads are typically polyurethane-based, pressure sensitive adhesive (PSA). Generally, it is preferable that the upper pad (PAD B) is stiffer than the lower pad (PAD A). In the case that both pads are doped with polyurethane resin, this can be achieved simply by doping PAD B with more polyurethane than PAD A. Typical pad thickness is on the order of 0.050 inches.

Two failure modes are of particular interest. In one mode, the slurry is gradually "wicked" into the pads and gradually attacks the adhesive, and adhesive failure can be expected in about thirty days of usage, which is generally acceptable. This is illustrated at 124, where slurry 112 is shown permeating PAD B and attacking adhesive 110 at the pad-to-pad interface of the upper and lower pads. In another, much more catastrophic mode, the slurry attacks the adhesive bond between PAD A and PAD B directly, edgewise at the adhesive boundary (pad-to-pad interface) between the pads, and failure may occur within one half hour, which is very unacceptable. This is illustrated at 126, where slurry is shown attacking the adhesive 110 edgewise between the two pads. Eventually, and usually abruptly, the pads will delaminate (come unglued) from one another, which will require stopping the polishing process (possibly damaging an in-process wafer), and re-setting up the polishing equipment. This is not desirable.

It is known to provide a plastic or rubber ring (dam) around the periphery of the pads and platen, extending upward above the front face of the upper pad (PAD B), primarily for the purpose of creating a reservoir of slurry on the front face of PAD B, which will allow the slurry to be retained longer on the face of PAD B.

FIG. 2 illustrates a technique 200 whereby a rubber ring/dam 202 encircling an upper pad 204, a lower pad 206 and a platen 208, and extending above the front surface of the upper pad 202. In this manner, a "pool" 210 of slurry (shown as several rows of dots) is created on the face of the upper pad, which allows greater residence time in which the slurry can perform its intended function before washing over the top edge of the dam 202.

Use of the dam/ring is primarily directed to optimizing interaction of the slurry with the wafer before the slurry overflows the dam/ring, and requires additional set-up of the polishing apparatus. And, to a much lesser degree, use of the ring/dam may slightly impede slurry from directly attacking the adhesive 212 in the pad-to-pad interface.

Therefore, there remains a need for effectively addressing the problem of catastrophic delamination of the polishing pads due to slurry attacking the adhesive at the pad-to-pad interface.

As noted above, pad replacement is required at regular intervals. A manufacturer of polishing equipment is Westech (Phoenix, AZ), and of pads is Rodel (Scottsdale, AZ). Pages 13 and 14 of Westech Polisher manual describe the usual process of replacing the pads. As noted therein, "polish pads must be replaced after 15 to 20 hours of operation, or more frequently if there is excessive buildup of [slurry]." Experience shows that replacement may be required after only a few hours of use due to the delamination of the pads resulting from encroachment of the slurry solution into the pad-to-pad interface. It is suspected that the slurry solution acts as a release agent for the PSA (adhesive) film between the pads (see, e.g., FIG. 1, 110).

Understandably, the replacement pads are shipped oversize, larger than the platen to which they will be mounted, so that they may be mounted (adhered) to the platen and then trimmed to size. For purposes of this discussion, the platen has a diameter of 30 inches, and the pads are shipped with a diameter of 33 inches. If the pads were shipped the same size as the platen, a minor misalignment when adhering the pads to the platen would result in exposing the platen surface. This is undesirable for many reasons, among which is the possibility that the slurry will etch the front face of the platen. By way of analogy, those familiar with installing formica (TM) will appreciate that an oversize sheet of formica is fitted to an underlying substrate (e.g., a counter top), and is then trimmed in place to match the peripheral contour of the counter top.

Whether using one or two pads (a two pad system is shown in FIG. 1), the straightforward, recommended technique for trimming the pads is simply to trim them flush around the edge (periphery) of the platen. (See Westech manual, page 14, paragraph "7.") This trimming is suitably accomplished, by hand, with a sharp razor blade or utility knife.

FIGS. 3A and 3B illustrate a technique 300 for assembling polishing pads to a platen for chemi-mechanical polishing. Two pads, an upper pad 302 and a lower pad 304, mounted to a platen 306 (the platen is not visible in FIG. 3A, and the adhesive is omitted for illustrative clarity). In this illustration, neither of the pads are trimmed. As is evident from the illustration, the top pad 302 is slightly mis-aligned over the bottom pad 304. This results in the bottom pad 304 protruding beyond the edge of the upper pad 302 in a region 308 extending partially about the circumference of the upper pad. Evidently, the protruding region of the bottom pad 304 forms a "shelf" 310 where slurry can readily collect and attack the adhesive film (not shown) between the two pads by migrating between the two pads. This configuration of pads is typical, albeit exaggerated for illustrative purposes. Although polishing can be performed with pads misaligned as shown, it is expected that they would need replacement on a frequent basis.

FIGS. 4A and 4B show the recommended technique 400 for assembling polishing pads to a platen for chemi-mechanical polishing. Two pads, an upper pad 402 and a lower pad 404, are mounted to a platen 406 (lower pad 404 and platen 40 not visible in FIG. 4A; adhesive omitted for clarity). In this illustration, both pads are trimmed according to standard procedure, i.e., to be coincident with the edge of the platen. In this example, as liquid (slurry) runs over the edge of the pad stack, it merely contacts the edge of the interface between the two pads (See FIG. 1). Nevertheless, the slurry can still migrate between the upper and lower pads, attacking the adhesive layer therebetween, and causing premature delamination of the pad stack. Again, although polishing can be performed with pads neatly trimmed as shown, it is expected that they would need replacement on a frequent basis, albeit less frequently than the misaligned pads of FIGS. 3A and 3B.

DISCLOSURE OF THE INVENTION

It is an object of the present invention to provide improved techniques for chemi-mechanical polishing of semiconductor wafers.

It is another object of the present invention to provide a technique for reducing catastrophic delamination failures between the two polishing pads of a chemi-mechanical polishing apparatus.

It is a further object of the present invention to provide a technique for diverting the polishing slurry solution away from the adhesive film between pads, without using a separate ring/dam structure.

It is a further object of the present invention to provide a technique for creating a "pool of slurry" on the front face of a polishing pad, integral with the pad, reducing the amount of slurry needed to accomplish a given chemi-mechanical polishing procedure, and without requiring additional mechanical elements such as a dam/ring structure.

According to the invention, two polishing pads, an upper pad and a lower pad, both nominally of diameter "D" are assembled to a rotating platen of smaller diameter "d" ($d<D$).

The lower (bottom) pad is first assembled by itself to the platen, and is trimmed to be coincident with the circumferential edge of the platen. (The lower pad can be also be trimmed slightly smaller than the platen.) Initially larger than the platen, the lower pad is nominally centered on the platen so that it overhangs the platen all around the platen's circumference. It is then trimmed (e.g., by hand) with a razor blade, utility knife, or the like.

The upper (top) pad is then assembled to the bottom pad. As with the bottom pad, the top (upper) pad is initially larger than the platen, having a diameter "D" greater than the diameter of the platen "d" ("D">"d"). However, unlike the bottom pad, the top pad is not trimmed to the size of the platen. Rather it is nominally centered on the platen so that an edge portion of the upper pad extends beyond the periphery of the lower pad (e.g., beyond the platen) at all circumferential positions of the platen (e.g., lower pad).

In this manner, polishing slurry running over the face of the top pad is positively diverted away (radially outward) from the interface between the two pads, without requiring the use of an additional mechanical element such as a dam/ring.

The extending (beyond the platen) edge portion of the upper pad can be created simply by not trimming the initially oversize (vis-a-vis the platen) upper pad. Alternatively, the extending edge portion can be slightly trimmed to be concentric with the platen yet still extending beyond the platen (particularly beyond the edge of the lower pad).

However, it is possible that slurry will migrate under the extending edge portion of the upper pad, due to surface tension or the like, and make its way to the pad-to-pad interface between the upper and lower pads, where it can attack the adhesive bond holding the stack of pads together. Albeit, the diversion created by the extended edge portion will diminish this possibility.

Therefore, according to a feature of the invention, the extending edge portion of the upper pad is additionally bent downwards (e.g., by hand), preferably past the level of the pad-to-pad interface, to overhang the lower pad, so that it is all the more difficult for slurry washing over the face of the upper pad to migrate entirely around the extending/overhanging edge portion, upwards (against gravity) to the pad-to-pad interface.

According to an aspect of the invention, in the process of bending the extending edge portion of the upper pad downward, to overhang the lower pad, a light pressure is maintained (e.g., by hand) on the upper pad, at and inward of the edge of the platen (i.e., lower pad), so that the bending moment applied to the upper pad does not cause the upper pad to begin delaminating mechanically (versus chemically by action of slurry) from the lower pad, leaving a gap at the pad-to-pad interface which would tend to facilitate slurry invasion (migration) into the interface.

According to a feature of the invention, in the process of bending the overhanging edge of the upper pad downward, a light pressure is maintained on the upper pad, not at but rather slightly (on the order of one inch) inward of the edge of the platen (i.e., lower pad), so that when the overhanging edge is bent downwards, a peripheral region of the upper pad, inward of the overhanging edge but outward of the holding force area, is deformed upwards above the face of the upper pad. This forms (creates) an annular (ring like) lip or hillock, integral with the upper pad and extending sufficiently above the otherwise planar face of the pad to create a small pool of slurry on the face of the pad. In this manner, the residence time of slurry on the face of the pad can be increased, and usage of slurry can be decreased.

The invention is also useful when mounting a single pad to a platen for chemi-mechanically polishing semiconductor wafers. With only one pad the pad would be allowed to extend beyond the edge of the platen, could be bent downwards, and could be allowed to form an annular hillock extending above the face of the pad—all for the reasons set forth above. However, as mentioned above, delamination of a pad from a relatively non-porous platen is not as much of a problem as pad-to-pad delamination.

Other objects, features and advantages of the present invention will become apparent in light of the following description thereof.

DETAILED DESCRIPTION OF THE INVENTION

Figure 1:
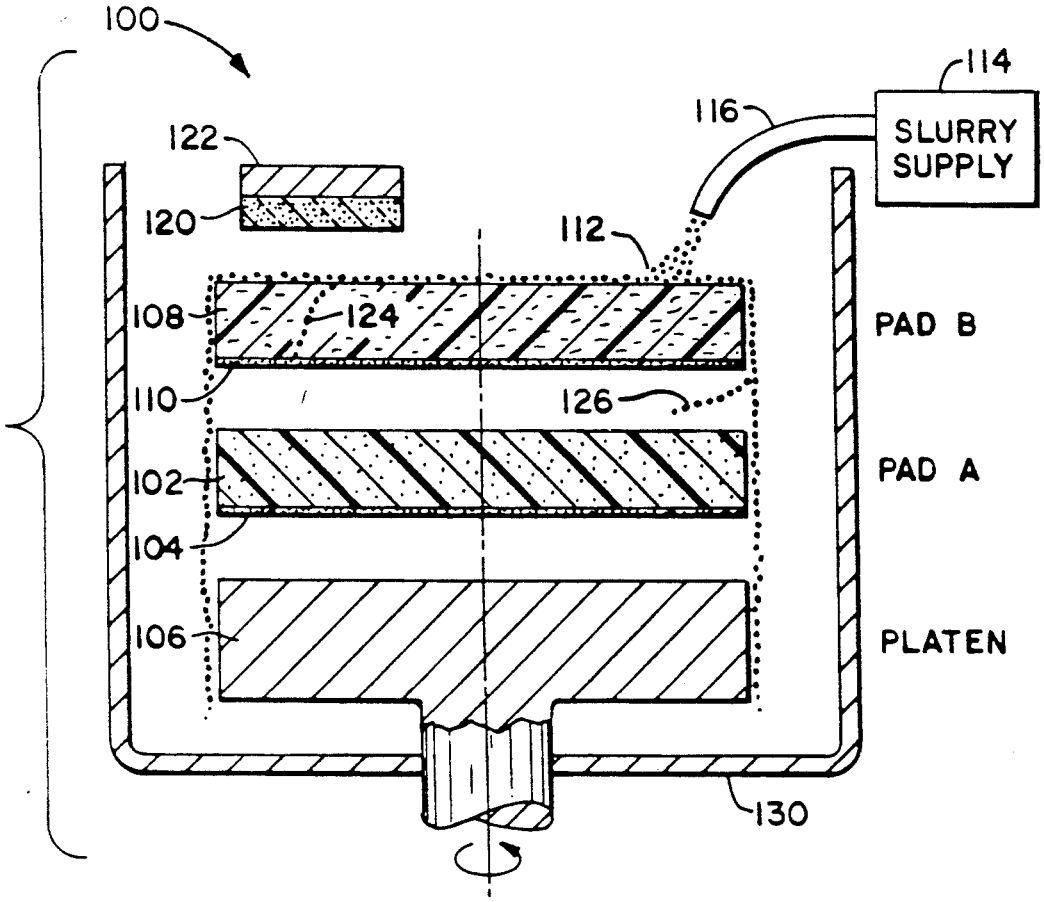
FIG. 1 PRIOR ART
FIG. 1 is an exploded, stylized, cross-sectional view of prior art chemi-mechanical polishing apparatus.

FIG. 1 shows chemi-mechanical polishing apparatus 100 of the prior art, and has been discussed above.

Figure 2:
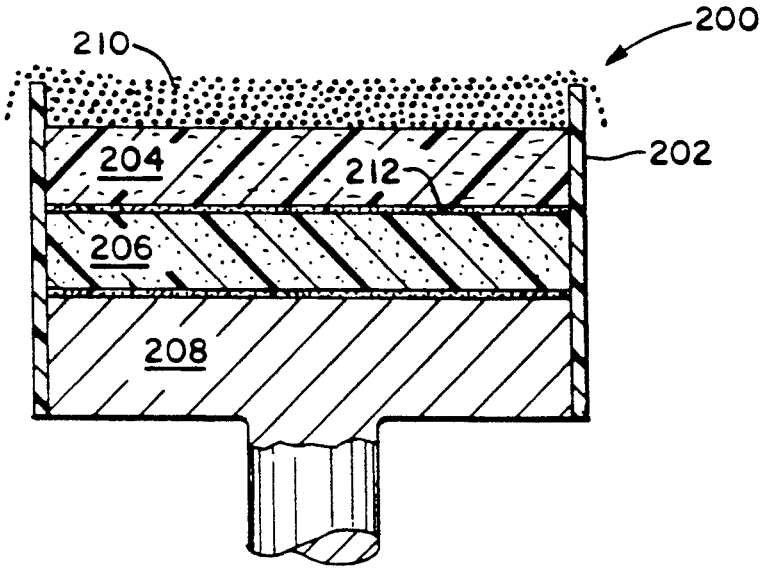
FIG. 2 PRIOR ART
FIG. 2 is a stylized cross-sectional view of a prior art chemi-mechanical polishing process utilizing a ring (dam) around the pads and platen.

FIG. 2 shows chemi-mechanical polishing apparatus 200 of the prior art, and has been discussed above.

Figure 3A:
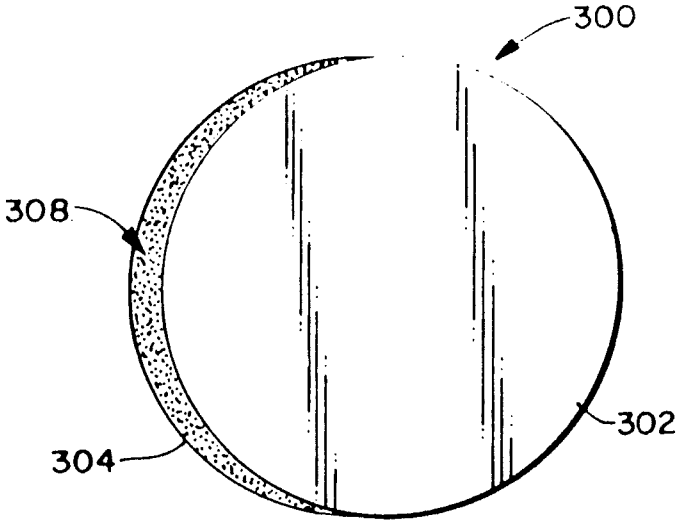
FIG. 3A PRIOR ART
FIG. 3A is a stylized plan view of a prior art technique for assembling polishing pads to the platen of a chemi-mechanical polishing apparatus.
Figure 3B:
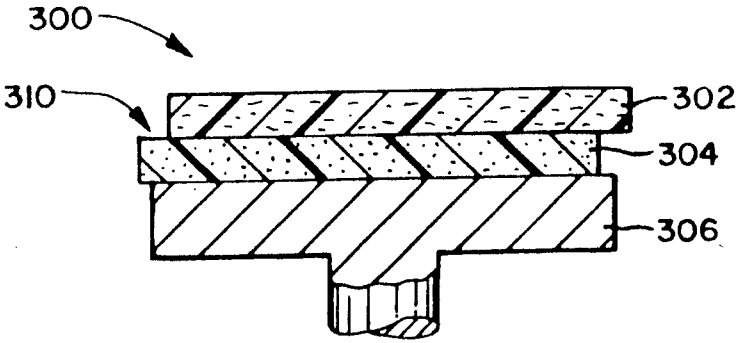
FIG. 3B PRIOR ART
FIG. 3B is a stylized cross-sectional view of the technique of FIG. 3A.

FIGS. 3A and 3B show chemi-mechanical polishing apparatus 300 of the prior art, and have been discussed above.

Figure 4A:
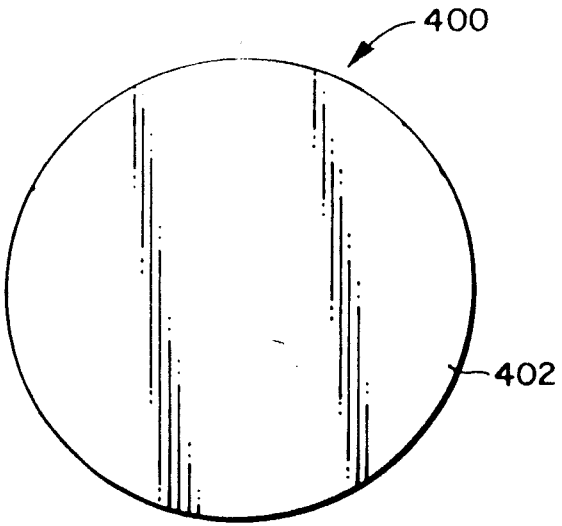
FIG. 4A PRIOR ART
FIG. 4A is a stylized plan view of a prior art technique for assembling polishing pads to the platen of a chemi-mechanical polishing apparatus.
Figure 4B:
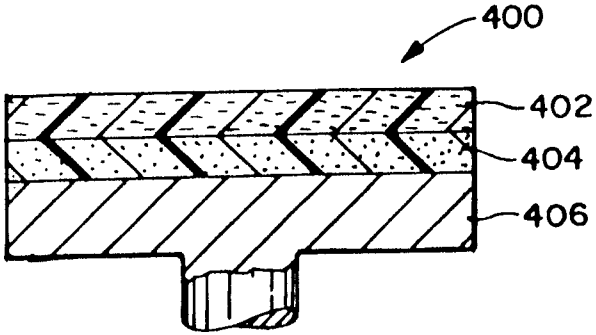
FIG. 4B PRIOR ART
FIG. 4B is a stylized cross-sectional view of the technique of FIG. 4A.

FIGS. 4A and 4B show chemi-mechanical polishing apparatus 400 of the prior art, and have been discussed above.

As discussed above, a significant problem in performing chemi-mechanical polishing of silicon wafers with a stack of two polishing pads is catastrophic delamination of the pads due to migration of polishing slurry into the pad-to-pad interface between two pads of a pad stack. And, as discussed above, a desirable objective in chemi-mechanical polishing is providing a dam or the like to increase residence time of the slurry on the front face of the polishing pad (whether using one or two pads) before the slurry washes over the face of the pad and is irretrievably lost.

Figure 5A:
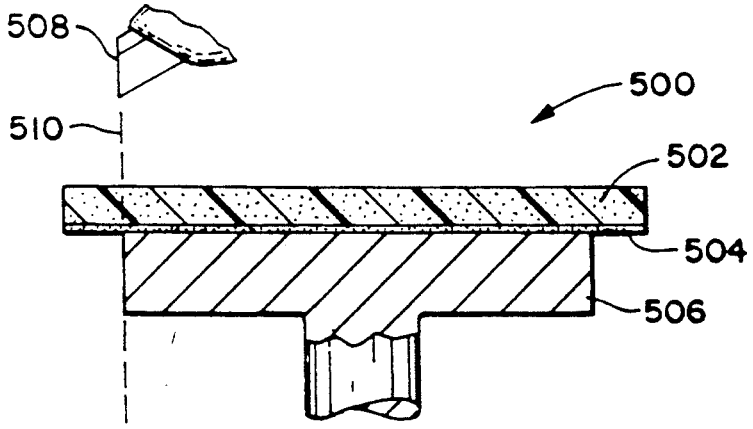
FIG. 5A is a stylized cross-sectional view of a technique for assembling polishing pads to the platen of a chemi-mechanical polishing apparatus, according to the present invention.
Figure 5B:
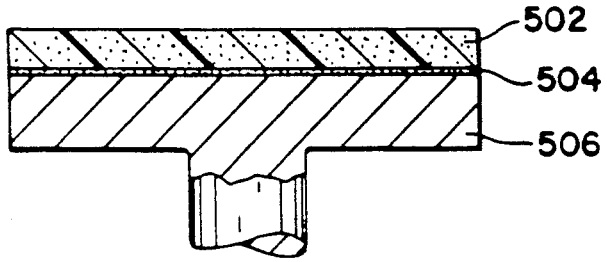
FIG. 5B is a stylized cross-sectional view of the technique of FIG. 5A, at a subsequent step.
Figure 5C:
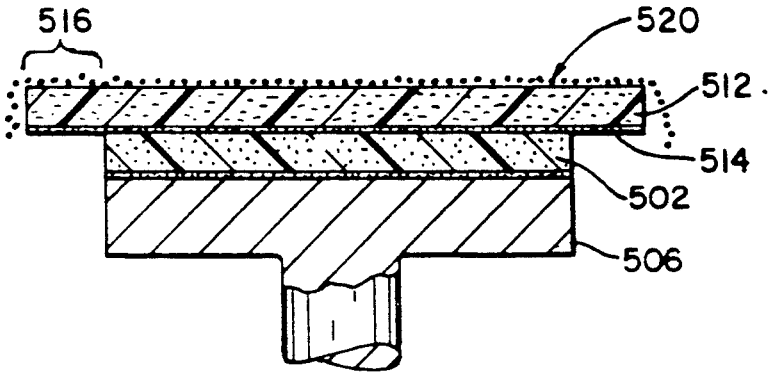
FIG. 5C is a stylized cross-sectional view of the technique of FIG. 5A, at a step subsequent to that of FIG. 5B.

FIGS. 5A through 5C show a technique 500 of assembling polishing pads to a platen, according to the present invention.

As shown in FIG. 5A, a polishing pad 502 having a thin layer of self-sticking adhesive 504 on its back face is adhered to the front face of a rotating platen 506. The polishing pad has a diameter "D" (typically 33 inches) larger than the diameter "d" (typically 30 inches) of the platen, and has a thickness "t" on the order of 0.050 inches.

The platen 506 is rotated (e.g., by hand), and the pad 502 is trimmed with a razor blade 508 (or utility knife, or the like) so that its outer edge is substantially coincident with the outer edge of the platen. This is indicated by the dashed line 510. FIG. 5B shows the pad 502, trimmed to the size of the platen. The pad 502 may also be trimmed to be slightly (e.g., a fraction of an inch) smaller or larger than the platen, but neither of these options is as preferred as the pad being trimmed to rearly exactly the size of the platen.

The pad 502 forms the lower pad of a two-pad stack of polishing pads.

A second polishing pad 512 having a thin layer of self-sticking adhesive 514 on its back face is adhered to the front face of the first pad 502. The polishing pad 512 has a diameter "D" (typically 33 inches) larger than the diameter "d" (typically 30 inches) of the platen/-trimmed lower pad 502.

The pad 512 forms the upper pad of a two-pad stack of polishing pads.

The upper pad 512 is left oversize (vis-a-vis the platen/lower pad). In this manner, an edge portion 516 of the upper pad 512 remains extending beyond the edge of the platen (and beyond the edge of the trimmed lower pad). In one case, the upper pad is simply left untrimmed. However, it may have been installed slightly off-center with respect to the plated, in which case it may be trimmed (not shown) to be concentric with the platen while still exhibiting an edge portion 516 extending beyond the edge of the platen.

A suitable dimension for the edge portion of the upper pad is at least about 0.075 inches, or $2\pi t/4$ ("t" is the thickness of the lower pad 502).

Ultimately, a silicon wafer (not shown) will be lightly pressed against the front surface of the upper pad 512, in a central area thereof (as discussed above), and the platen rotated, so that irregular topographical formations (on the wafer) sought to be polished are acted upon by the action of chemi-mechanical polishing slurry 520 on the face of the upper pad 512.

As shown in FIG. 5C, while polishing slurry 520 will still wash over the edge of the upper pad 512, it is evident that the edgewise catastrophic failure mode is alleviated by virtue of the edge region 516 of the upper pad extending beyond the edge of the lower pad.

However, it is still possible that a small amount of the polishing slurry washing over the face of the upper pad 512 will creep under the extending edge 516 and migrate into the pad-to-pad interface between the two pads, attacking the adhesive bond therebetween. Nevertheless, the improvement over the prior art (see, e.g., FIGS. 1, 2, 3A, 3B, 4A and 4B) will be significant.

Wicking, or migration of slurry directly through the upper pad, as discussed above, will still occur at the acceptable rate of the prior art (much less catastrophic).

Typical pad materials are: (1) for the lower pad 502, foamed polyurethane; and (2) for the upper pad 512, polyester felt stiffened with polyurethane resin. The adhesive backings 504 and 514 for the pads are typically polyurethane based. Generally, it is preferable that upper pad is stiffer than the lower pad. In the case that the lower pad is also doped with polyurethane resin, this can be achieved simply by doping the upper pad with more polyurethane resin than the lower pad.

Allowing an edge region of the upper pad to extend beyond the edge of the lower pad is easily accomplished, while maintaining planarity of the front surface of the upper pad. Nevertheless, it would be imprudent to polish a wafer in the extending region 516, which is not supported by the platen/lower pad. In any event, polishing is "deemed" to take place preferably on approximately the inner two-thirds area of the platen anyway, as discussed hereinabove.

Figure 6:
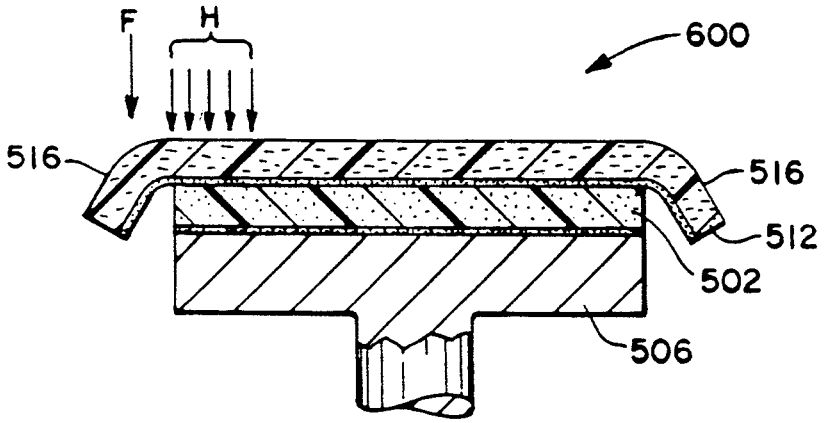
FIG. 6 is a stylized cross-sectional view of another technique for assembling polishing pads to the platen of a chemi-mechanical polishing apparatus, according to the present invention.

FIG. 6 shows another technique 600 of assembling polishing pads to a platen, according to the present invention.

Beginning with the end result of the technique shown in FIGS. 5A through 5C, the region 516 of the upper pad 512 extending beyond the edge of the lower pad 502 is bent downward to overhang the lower pad.

This is accomplished by applying a bending force "F" downward on the edge region 516 of the upper pad 512. The force "F" is readily applied by hand, while rotating the platen 506.

Evidently a bending moment will be generated when applying the force "F", which could cause the upper pad 516 to buckle upwards in an area just inside the edge of the platen. Hence, a holding force "H" is applied downward to the front face of the upper pad in this critical area at an inward of the edge of the platen. In this manner, planarity of the upper pad is assured.

Hence, the extending edge portion 516 of the upper pad may readily be deformed downward, to further alleviate any tendency for slurry to migrate around the edge, underneath the upper pad, and into the pad-to-pad interface, causing premature delamination of the pads.

Preferably, the edge region 516 of the upper pad is deformed sufficiently to completely overhang the lower pad, in other words so that its edge is ultimately disposed below the bottom of the lower pad. In the case of the edge region 516 of the upper pad being bent with a constant radius "r" equal to the thickness "t" of the lower pad, this requires that the edge region of the upper pad extend at least $2\pi t/4$ beyond the edge of the lower pad.

Whereas in the technique 500 of FIGS. 5A–5C, the upper pad was simply left untrimmed (or slightly trimmed) so as to have an edge region extending beyond the edge of the lower pad, and thereby reducing a tendency for slurry to migrate into the pad-to-pad interface, in this example the edge region of the upper pad is advertently deformed downward so as to be disposed preferably entirely below the pad-to-pad interface.

While polishing slurry will still wash over the edge of the upper pad 512, it is evident that the umbrella-like downwardly-bent edge region will virtually assure that no slurry will possibly migrate into the pad-to-pad interface Again, wicking may still occur, but is of far less concern than a direct attack of slurry on the pad-to-pad interface.

As noted above, the overhanging edge is easily accomplished, while maintaining planarity of the front surface of the upper pad.

Figure 7:
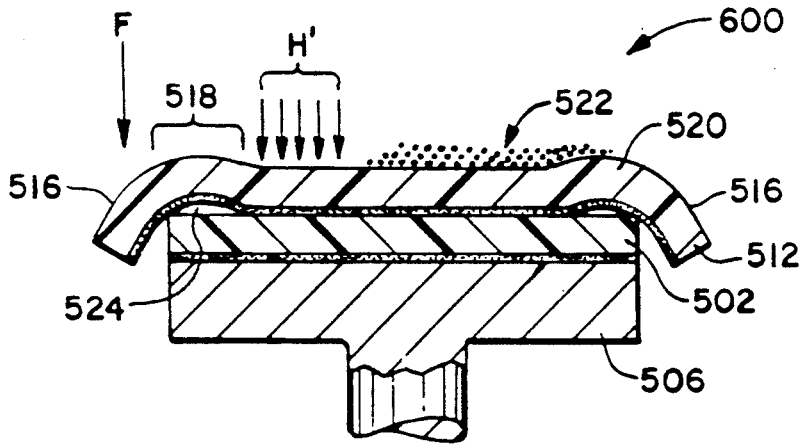
FIG. 7 is a stylized cross-sectional view of yet another technique for assembling polishing pads to the platen of a chemi-mechanical polishing apparatus, according to the present invention.

FIG. 7 shows yet another technique 700 of assembling polishing pads to a platen, according to the present invention.

In a manner similar to that of FIG. 6, the region 516 of the upper pad 512 extending beyond the edge of the lower pad 502 is bent downward to overhang the lower pad.

Again, this is accomplished by applying a bending force "F" downward on the edge region 516 of the upper pad 512. The force "F" is readily applied by hand, while rotating the platen 506.

Evidently a bending moment will be generated when applying the force "F", which could cause the upper pad 516 to buckle upwards in an area just inside the edge of the platen. In the technique of FIG. 6, a holding force "H" was applied downward to the front face of the upper pad to prevent such buckling.

According to the present technique 700, however, an outer region 518 of the upper pad is permitted to buckle upwards. This region 518, where the holding force of FIG. 6 was applied, is located from just inside of the extending region 516 (or, from the edge of the lower pad), inward towards the center of the platen, on the order of two to three quarters of an inch. A holding force "H'" is preferably applied to the face of the upper pad just inside of the buckling region 518.

FIG. 7 shows, greatly exaggerated, an annular lip or hillock 520 being formed by the upper pad 512 in the outer region 518 by allowing the edge region 518 to buckle upwards when bending the edgemost extending region 516 downwards.

FIG. 7 shows that the annular hillock 520 forms a pool of slurry, indicated by several rows of dots 522, which will allow a greater residence time for the slurry on the face of the upper pad.

Evidently, the annular hillock 520 is a non-planar feature of the front face of the upper pad 512. However, inasmuch as the pad is planar interior of this feature, polishing can still proceed in a central region of the pad.

FIG. 7 shows that a void space 524 may be created at the pad-to-pad interface directly underneath the hillock 520 However, since slurry is aggressively diverted away by the extending and overhanging edge portion 516 of the upper pad, this is of little consequence. If, however, such as void 524 is of concern, it is readily remedied by applying a thin bead of silicon caulk, or the like, to an outer region of the lower pad, in this area, prior to installing and bending the upper pad.

In use (in any of the above embodiments), the platen is rotated, and a metered stream of slurry is delivered to the front face of the upper pad.

In the embodiment of FIGS. 5A–5C, an extending edge of the upper pad decreases the opportunity for slurry washing over the face of the upper pad to attack the pad-to-pad interface.

In the embodiment of FIG. 6, an extending and overhanging edge of the upper pad further decreases the opportunity for slurry washing over the face of the upper pad to attack the pad-to-pad interface.

With respect to the FIGS. 5A–5C and 6 embodiments, it has been demonstrated that catastrophic delamination of the polishing pads has been significantly delayed, on the order of matching or exceeding the time required for the wicking failure mode (i.e., about thirty days).

In the embodiment of FIG. 7, an extending and overhanging edge of the upper pad, which has also created an annular lip around the face (front surface) of the upper pad, allows for increased residence time of slurry on the face of the upper pad and more effective use of the slurry. Indications are that by using the technique of the present invention, a noticeable decrease in the feed rate of slurry can be achieved. In light of the relatively high cost of polishing slurry, it is readily seen that either (1) less slurry can be used, or (2) a more expensive slurry can be used with no net increase in cost.

A question comes to mind, namely why is there seemingly no concern over catastrophic delamination of the lower pad (e.g., 502) from the platen. The answer, simply stated, is that inasmuch as the platen is a flat, smooth, relatively non-porous surface, a more "intimate" bond is created between the lower pad and the platen than between two compliant pads.

In the case of chemi-mechanical polishing with only a single pad, it is contemplated that the single pad could also be sized and shaped to extend down over the edge of the platen to direct slurry washing over the face of the pad away from the adhesive holding the pad to the platen. Further, as noted above, the annular hillock that can be created when bending the edge of the oversize upper pad down over the edge of the platen can create a beneficial "reservoir" of slurry on the front face of the pad. As noted above, using two pads is preferred.

What is claimed is:

1. Method of assembling polishing pads to the platen of apparatus for chemi-mechanical polishing of semiconductor wafers, comprising:

assembling a first planar polishing pad to a platen of a chemi-mechanical polisher, the platen having an outer edge and a diameter "d";

trimming the first polishing pad so that an outer edge of the first polishing pad is coincident with the outer edge of the platen;

assembling a second polishing pad, having a front face for polishing a wafer, to the first polishing pad, the second polishing pad having a diameter "D" greater than the diameter "d" of the platen, so that an edge portion region of the second polishing pad extends beyond the periphery of the first polishing pad about the entire circumference of the first polishing pad, the front face of the second polishing pad being exposed after assembling to the first polishing pad for polishing the wafer.

2. Method according to claim 1, wherein:

the first polishing pad has a diameter greater than the diameter "d" of the platen, prior to trimming; and further comprising:

trimming the first polishing pad so that a circumferential edge of the first polishing pad is coincident with the edge of the platen.

3. Method according to claim 1, further comprising:

bending the extending edge portion of the second polishing pad downward in the direction of the first polishing pad;

wherein:

during and after bending the second polishing pad, the first polishing pad remains planar.

4. Method according to claim 3, further comprising:

applying a holding force to the front face of the second polishing pad while bending the extending edge portion downwards.

5. Method according to claim 3, further comprising:

bending the extending edge portion of the second polishing pad downward sufficiently to entirely overhang the first polishing pad.

6. Method according to claim 5, wherein:

the first polishing pad had a thickness "t";

the extending edge portion of the second polishing pad extends a distance $2\pi t/4$ beyond the edge of the first polishing pad.

7. Method according to claim 3, further comprising:

while bending the extending edge portion of the second polishing pad downward, causing an annular lip to be formed on the exposed front face of the second polishing pad, said annular lip formed integral with the second polishing pad.

8. Method according to claim 7, further comprising:

applying a holding force to the front face of the second polishing pad while bending the extending edge portion downwards.

9. Method according to claim 7, wherein:

a void is created under the annular lip, between the first and second polishing pads; and further comprising:

filling the void with silicon caulk.

* * * * *